US009991641B1

(12) United States Patent
Annis et al.

(10) Patent No.: US 9,991,641 B1
(45) Date of Patent: Jun. 5, 2018

(54) ELECTRICAL CONNECTOR HAVING A CONTACT ORGANIZER

(71) Applicant: TE CONNECTIVITY CORPORATION, Berwyn, PA (US)

(72) Inventors: Kyle Gary Annis, Hummelstown, PA (US); Keith Edwin Miller, Manheim, PA (US); Kevin Michael Thackston, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/654,086

(22) Filed: Jul. 19, 2017

(51) Int. Cl.

| | |
|---|---|
| ***H01R 13/502*** | (2006.01) |
| ***H01R 13/6582*** | (2011.01) |
| ***H01R 13/516*** | (2006.01) |
| ***H01R 13/506*** | (2006.01) |

(52) U.S. Cl.
CPC ..... *H01R 13/6582* (2013.01); *H01R 13/506* (2013.01); *H01R 13/516* (2013.01)

(58) Field of Classification Search
CPC H01R 13/6582; H01R 13/516; H01R 11/282; H01R 13/5812; H01R 13/6272; H01R 13/506; H01R 13/6275
See application file for complete search history.

(56) References Cited

U.S. PATENT DOCUMENTS

| | | | | |
|---|---|---|---|---|
| 4,421,376 | A * | 12/1983 | Cosmos | H01R 13/516 439/350 |
| 4,838,808 | A * | 6/1989 | Fujiura | H01R 13/6275 439/347 |
| 7,175,465 | B1 * | 2/2007 | Tsai | H01R 13/6275 439/352 |
| 7,374,464 | B1 * | 5/2008 | Vicenza | H01R 11/282 439/769 |
| 7,670,180 | B2 | 3/2010 | Gerard et al. | |
| 7,841,889 | B2 | 11/2010 | Gerard et al. | |
| 8,550,839 | B2 * | 10/2013 | Fabian | H01R 13/506 439/460 |
| 9,595,787 | B2 * | 3/2017 | Qiao | H01R 13/6272 |
| 9,768,548 | B2 * | 9/2017 | Pegel | H01R 13/5812 |

* cited by examiner

*Primary Examiner* — Jean F Duverne

(57) ABSTRACT

An electrical connector includes a shell and a contact organizer received in the shell including contact channels each having an open side between a front and a rear of the contact organizer. The contact organizer has locating shoulders in corresponding contact channels and securing detents extending into corresponding contact channels. Contacts are terminated to cables and are received in contact channels through the open sides. Each contact has a flange engaging the corresponding locating shoulder to hold an axial position of the contact within the contact channel. Each contact has an exterior surface engaging the corresponding securing detent to retain the contact in the contact channel by resisting removal through the open side.

21 Claims, 12 Drawing Sheets

ELECTRICAL CONNECTOR HAVING A CONTACT ORGANIZER

BACKGROUND OF THE INVENTION

The subject matter herein relates generally to electrical connectors having contact organizers.

Electrical connector systems are typically provided with a pair of mating electrical connectors mated together to form an electrical connection for signal and/or power transmissions. One known example of an electrical connector is the D-subminiature or D-sub type of electrical connector named for a characteristic D-shaped metal shield at the mating interface. A D-sub electrical connector typically contains two or more parallel rows of pins or sockets surrounded by a D-shaped metal shield that provides mechanical support, ensures correct orientation, and screens against electromagnetic interference.

However, conventional D-sub electrical connectors are not without disadvantages. For example, the D-sub electrical connectors have a large envelope, which may be unfit for particular applications requiring a low profile electrical connector. Additionally, conventional D-sub electrical connectors utilize swing latches on the ends of the connector to connect the electrical connectors together. Such a swing latches require additional space on the sides of the connector to allow the latch is to swing and the swing latches are subject to damage and may be inadvertently unlatched. When one of the swing latches is damaged or unlatched, the connector may rotate or pivot causing possible electrical disconnects. Moreover, conventional D-sub electrical connectors having cables terminated to the contacts are typically potted or filled with the epoxy, making field termination impractical.

BRIEF DESCRIPTION OF THE INVENTION

In one embodiment, an electrical connector is provided including a shell having a mating cavity at a front of the shell and a cable cavity at a rear of the shell. The shell has a cable port between the cable cavity and an exterior of the shell receiving cables through the cable port. A contact organizer is received in the shell. The contact organizer includes contact channels each having an open side between a front and a rear of the contact organizer. The contact organizer has locating shoulders in corresponding contact channels and securing detents extending into corresponding contact channels. Contacts are terminated to corresponding cables and are received in corresponding contact channels through the corresponding open sides. Each contact has a flange engaging the corresponding locating shoulder to hold an axial position of the contact within the contact channel. Each contact has an exterior surface engaging the corresponding securing detent to retain the contact in the contact channel by resisting removal through the open side.

In another embodiment, an electrical connector is provided including a shell having a mating cavity at a front of the shell and a cable cavity at a rear of the shell. The shell has a cable port between the cable cavity and an exterior of the shell receiving cables through the cable port. A contact holder is received in the shell. The contact holder includes a front housing and a contact organizer coupled to a rear of the front housing, the front housing having a nose at a front of the front housing received in the mating cavity. The front housing includes a chamber at the rear of the front housing and contact bores extending between the front and the rear of the contact holder. The contact organizer includes contact channels each having an open side between a front and a rear of the contact organizer. The contact organizer has a tray at the front of the contact organizer including front channel segments of the contact channels. The contact organizer is coupled to the front housing such that the tray is received in the chamber of the front housing such that the front housing closes the open sides of the front channel segments of the contact channels. Contacts are received in corresponding contact channels through the corresponding open sides. The contacts have mating ends received in corresponding contact bores in the front housing and terminating ends terminated to corresponding cables.

In another embodiment, an electrical connector is provided including a shell having a mating cavity at a front of the shell and a cable cavity at a rear of the shell. The shell has a cable port between the cable cavity and an exterior of the shell receiving cables through the cable port. The shell has a pocket rearward of the mating cavity. A contact holder is received in the shell and secured in the pocket. The contact holder includes a front housing and a contact organizer coupled to a rear of the front housing. The front housing includes a flange having a front lip and a nose extending forward of the front lip received in the mating cavity. The front housing includes contact bores. The contact organizer has a flange having a rear lip. The contact organizer includes contact channels each having an open side between a front and a rear of the contact organizer. Contacts are received in corresponding contact channels through the corresponding open sides. The contacts have mating ends received in corresponding contact bores in the front housing and terminating ends terminated to corresponding cables. The flange of the front housing and the flange of the contact organizer are received in the pocket and secured in the pocket to secure the contact organizer to the front housing.

DETAILED DESCRIPTION OF THE INVENTION

Figure 1:
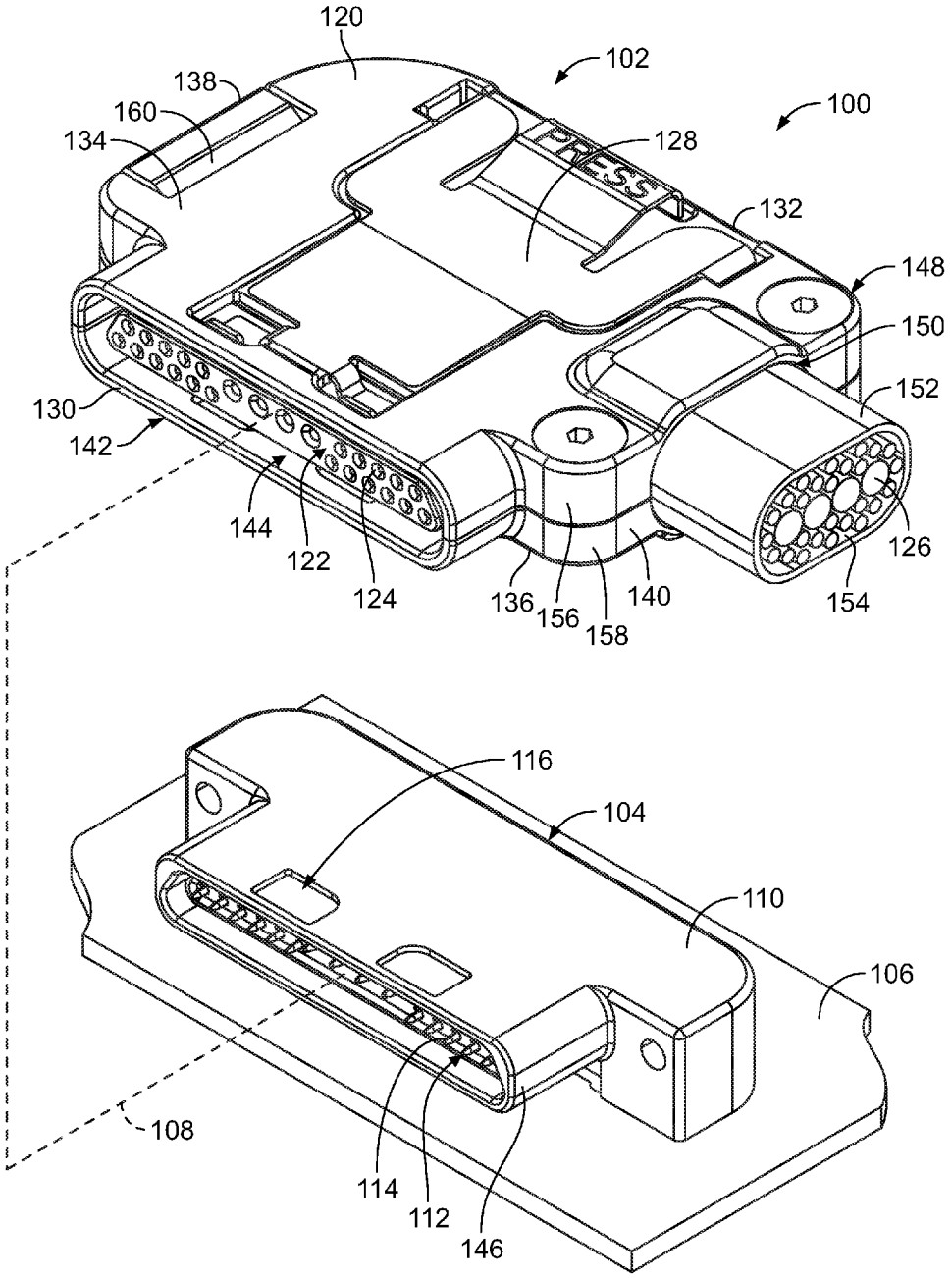
FIG. 1 illustrates an electrical connector system showing an electrical connector in accordance with an exemplary embodiment poised for mating with a header connector.

FIG. 1 illustrates an electrical connector system 100 in accordance with an exemplary embodiment showing an electrical connector 102 poised for mating with a header connector 104. The header connector 104 is mounted to a circuit board 106. The electrical connector 102 is coupled to the header connector 104 along a mating axis 108.

The header connector 104 includes a shell 110 and a contact assembly 112 in the shell 110. The contact assembly 112 includes a plurality of header contacts 114 configured to be mated to the electrical connector 102. The header contacts 114 are terminated to the circuit board 106. The shell 110 may provide electrical shielding for the header contacts 114. For example, the shell 110 may be manufactured from a conductive material, such as a metal material, to provide electrical shielding. Optionally, the shell 110 may be die cast; however, the shell 110 may be manufactured by other processes, such as being machined, molded from a conductive plastic, or being a plated plastic shell. In an exemplary embodiment, the header connector 104 includes latching features 116 for securing the electrical connector 102 to the header connector 104. For example, the latching features 116 may be pockets configured to receive a latch of the electrical connector 102.

The electrical connector 102 includes a shell 120 and a contact assembly 122. The contact assembly 122 includes a plurality of contacts 124 configured to be mated to the header contacts 114 of the header connector 104. The contacts 124 are terminated to cables 126 extending from the shell 120. The shell 120 may provide electrical shielding for the contacts 124 and the cables 126 and/or may provide electrostatic discharge protection. In various embodiments, the shell 120 may be manufactured from a conductive material, such as a metal material, to provide electrical shielding. Optionally, the shell 120 may be die cast; however, the shell 120 may be manufactured by other processes, such as being machined, molded from a conductive plastic, or being a plated plastic shell. In an exemplary embodiment, the electrical connector 102 includes a latching feature for securing the electrical connector 102 to the header connector 104. For example, the latching feature may be a clip 128 configured to be latchably coupled to the latching feature 116 of the header connector 104. The clip 128 includes an actuator or release tab for releasing the clip 128 from the latching feature 116.

In an exemplary embodiment, the shell 120 includes a front 130, a rear 132, a top 134, a bottom 136, a first side 138 and a second side 140. The front 130 defines a mating end 142 of the electrical connector 102 configured to be mated with the header connector 104. In an exemplary embodiment, the mating end 142 has a scoop proof interface to prevent damage to the contacts 124 during transportation, assembly and usage. The mating end 142 may be touch proof to prevent touching of the contacts 124. In an exemplary embodiment, the shell 120 defines a mating cavity 144 at the mating end 142 that receives a portion of the header connector 104. For example, the mating cavity 144 receives a nose 146 of the header connector 104 when mated thereto. In an exemplary embodiment, a portion of the contact assembly 122 extends into the mating cavity 144 for mating with the header connector 104. Optionally, the mating end 142 may be shaped for keyed mating with the header connector 104, such as having a D-shape. The mating end 142 may include features to reduce EMI leakage at the mating interface with the header connector 104. For example, the mating end 142 may include interference bumps to ensure electrical contact between the shell 120 and the header connector 104.

The rear 132 defines a cable end 148 of the electrical connector 102 configured to receive the cables 126. The cables 126 transition from the contact assembly 122 to a cable port 150 and exit from the shell 120 at the cable port 150. In the illustrated embodiment, the cable port 150 is provided at the second side 140; however, the cables 126 may exit from other portions of the shell 120 in alternative embodiments. Optionally, the cables 126 may be bundled together in an outer jacket 152. Optionally, the cable bundle may have a cable shield 154 terminated to the shell 120, such as at the cable port 150. The cable end 148 may include features to reduce EMI leakage at the cable port 150. For example, the cable end 148 may include a lip at the cable port 150 to tightly hold the cable 126. The cable end 148 may include interference ribs at the cable port 150 to ensure electrical contact between the shell 120 and the cable shield 154.

In an exemplary embodiment, the shell 120 includes an upper shell 156 and a lower shell 158. The upper shell 156 may be secured to the lower shell 158 by one or more fasteners. Optionally, the shell 120 may be a clamshell having the upper shell 156 hingedly coupled to the lower shell 158 by a hinge 160 at the first side 138.

Figure 2:
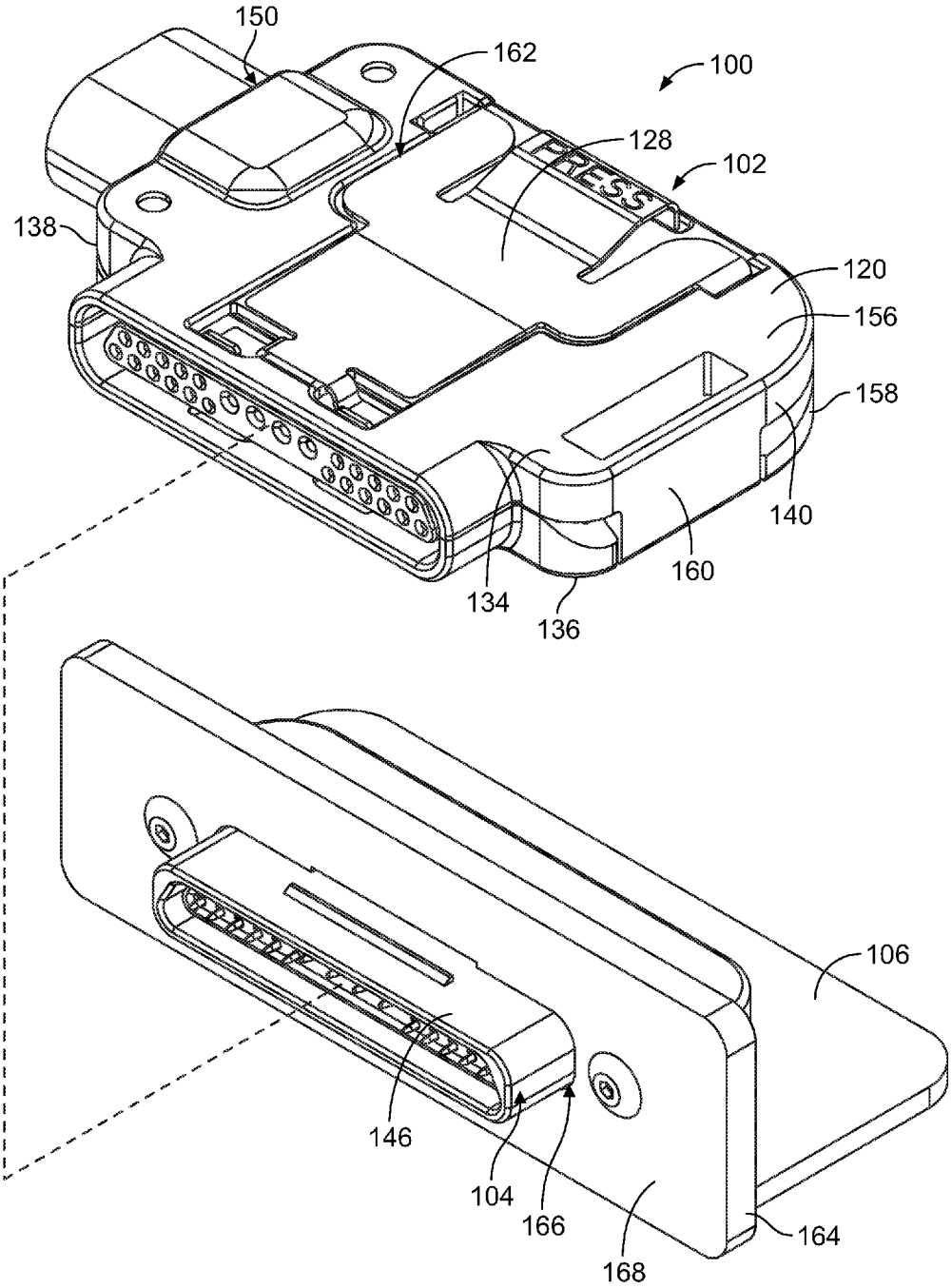
FIG. 2 shows the electrical connector system in accordance with an exemplary embodiment.

FIG. 2 shows the electrical connector system 100 in accordance with an exemplary embodiment. FIG. 2 illustrates the electrical connector 102 having the cable port 150 at the first side 138 and the hinge 160 at the second side 140. Optionally, the same shell 120 may be used in the different configurations illustrated in FIGS. 1 and 2 with the shell 120 flipped upside down or right side up in the different configurations. The clip 128 may be coupled to either end of the shell 120 such that the clip 128 is at the top 134 irrespective of the cable port 150 orientation. In an exemplary embodiment, the clip 128 is received in a recess in the shell 120. The interface between the clip 128 and the shell 120 may be designed to limit EMI leakage. Both shell pieces 156, 158 may include recesses 162 configured to receive the clip 128. In alternative embodiments, clips 128 may be provided at both the top 134 and the bottom 136.

In an exemplary embodiment, the header connector 104 may be mounted at an edge 164 of the circuit board 106 such that the nose 146 of the header connector 104 extends through an opening 166 and a panel 168 for mating with the electrical connector 102, rather than being mounted at a mid-board location as illustrated in FIG. 1.

Figure 3:
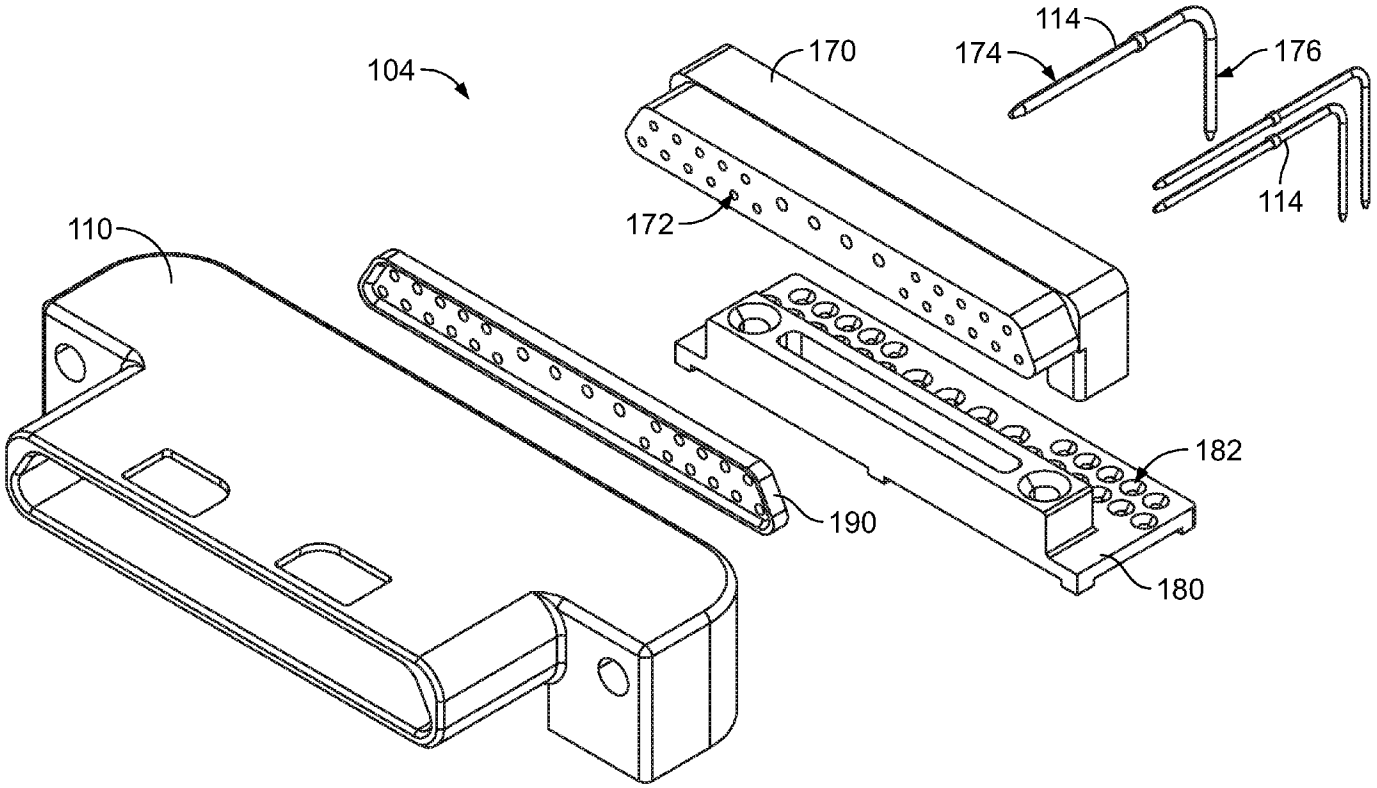
FIG. 3 is an exploded view of the header connector in accordance with an exemplary embodiment.

FIG. 3 is an exploded view of the header connector 104 in accordance with an exemplary embodiment. The header connector 104 includes a housing 170 having contact channels 172 configured to receive corresponding header contacts 114. Optionally, different types of header contacts 114 may be provided. For example, different size header contacts 114, different shaped header contacts 114 or different types of header contacts 114 may be provided. In the illustrated embodiment, the header contacts 114 are pin contacts having pins at mating ends 174 thereof. The header contacts 114 have solder tails at terminating ends 176 thereof configured to be soldered to the circuit board 106 (shown in FIG. 1). Other types of contacts may be provided in alternative embodiments. For example, the mating ends 174 may have sockets or other types of mating interfaces for mating with the electrical connector 102. The terminating ends 176 may have other types of mating interfaces for mating with the circuit board 106, such as compliant pins, spring beams, and the like. In other various embodiments, the terminating ends 176 may be configured to be terminated to cables rather than the circuit board 106 and may include crimp barrels or other means for terminating to the cables.

In an exemplary embodiment, the header connector 104 includes a contact organizer 180 having contact openings 182 configured to receive portions of the header contacts 114. For example, the contact openings 182 may receive the terminating ends 176 while the contact channels 172 receive the mating ends 174. The header contacts 114 are right angle contacts having a 90° bend transition between the mating ends 174 and the terminating ends 176. The header contacts 114 may have other shapes in alternative embodiments.

In an exemplary embodiment, the header connector 104 includes a gasket 190 configured to provide mechanical dampening for enhanced vibration performance and/or sealing between the header connector 104 and the electrical connector 102. The header contacts 114 may pass through the gasket 190 for interfacing with the electrical connector 102. The mating end of the electrical connector 102 may compress and seal against the gasket 190 when mated thereto. The gasket 190 may be provided at the front of the housing 170. The gasket 190, the housing 170 and the contact organizer 180 may be received in the shell 110, such as through the rear end or bottom of the shell 110.

Figure 4:
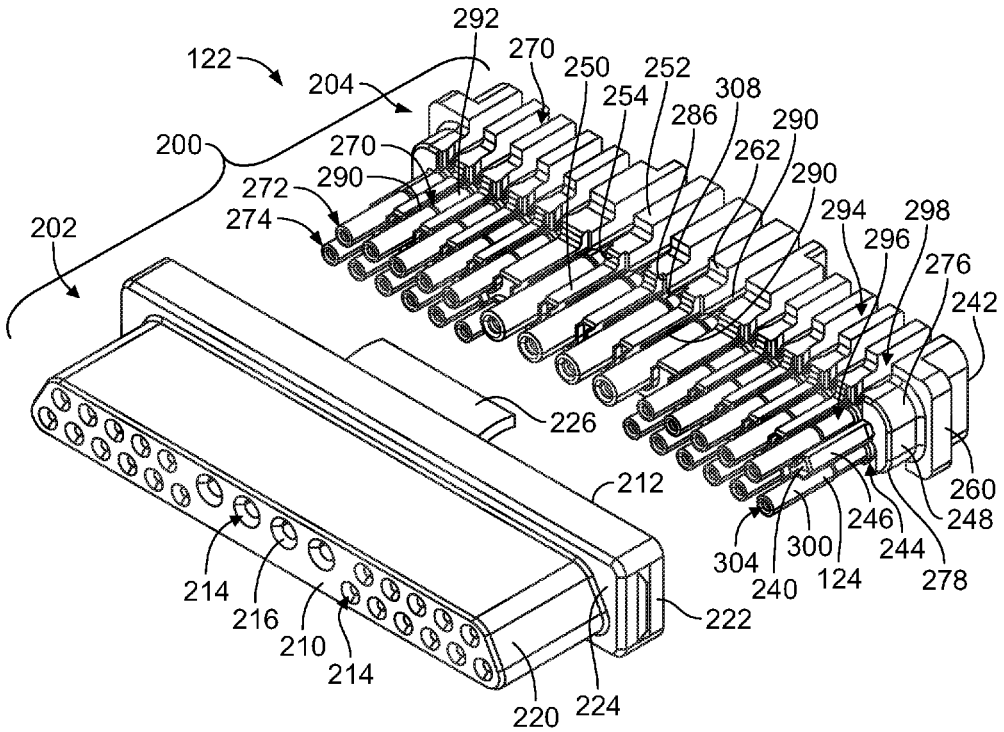
FIG. 4 is an exploded view of a contact assembly of the electrical connector in accordance with an exemplary embodiment.

FIG. 4 is an exploded view of the contact assembly 122 of the electrical connector 102 in accordance with an exemplary embodiment. The contact assembly 122 includes a contact holder 200 for holding the contacts 124. In the illustrated embodiment, the contact holder 200 is a multi-piece structure including a front housing 202 and a contact organizer 204 configured to be coupled to the front housing 202 to form the contact holder 200.

The front housing 202 extends between a front 210 and a rear 212. The front housing 202 includes a plurality of contact bores 214 that receive corresponding contacts 124. In an exemplary embodiment, the contact bores 214 are enclosed at the front 210 to entirely circumferentially surround the contacts 124 at the front 210. In an exemplary embodiment, the front housing 202 includes lead-ins 216 to the contact bores 214 at the front 210, such as to guide mating with the header contacts 114 (shown in FIG. 3). Optionally, the front housing 202 may include different side contact bores 214 for receiving different sized contacts 124.

The front housing 202 includes a nose 220 at the front 210. The nose 220 is configured to be received in the mating cavity 144 (shown in FIG. 1). The front housing 202 includes a flange 222 at the rear 212. The flange 222 is configured to be received in the shell 120 (shown in FIG. 1). The flange 222 is larger than the nose 220 and includes a front lip 224 extending at least partially around the perimeter of the nose 220. In the illustrated embodiment, the front lip 224 extends entirely circumferentially around the nose 220, such as above, below and flanking both sides of the nose 220. However, in alternative embodiments, the front lip 224 may be provided only at the sides rather than being provided above and below the nose 220. In an exemplary embodiment, the front housing 202 includes a stuffer 226 at the rear 212. The stuffer 226 extends rearward of the flange 222. The stuffer 226 is used to stuff the contacts 124 into the contact organizer 204 during assembly to seat the contacts 124 in the contact organizer 204. The front housing 202 may be devoid of the stuffer 226 in alternative embodiments.

Figure 5:
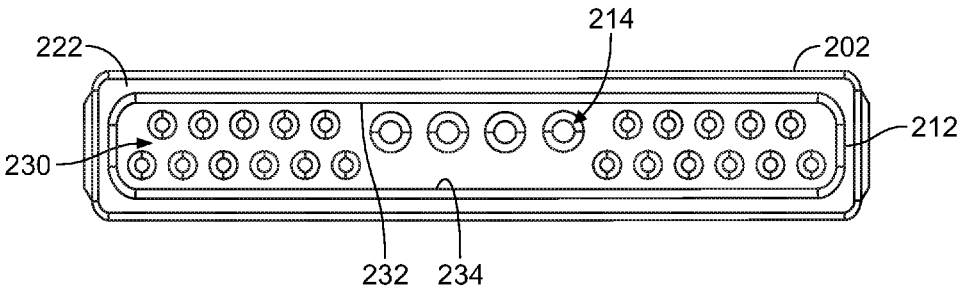
FIG. 5 is a rear view of a front housing of the contact assembly.

With additional reference to FIG. 5, which is a rear view of the front housing 202, the front housing 202 includes a chamber 230 at the rear 212. The chamber 230 is configured to receive a portion of the contact organizer 204. Optionally, the flange 222 extends entirely around the perimeter of the chamber 230. The contact bores 214 are open to the chamber 230 such that the contacts 124 may be loaded into the contact bores 214 through the chamber 230. In an exemplary embodiment, the chamber 230 is defined by an upper wall 232 and a lower wall 234. The upper and lower walls 232, 234 may cover portions of the contacts 124 when the contacts 124 are received in the chamber 230. In the illustrated embodiment, the upper and lower walls 232, 234 are planar and parallel to each other. However, the upper and lower walls 232, 234 may include divots or pockets configured to receive portions of the contacts 124 in alternative embodiments.

Figure 6:
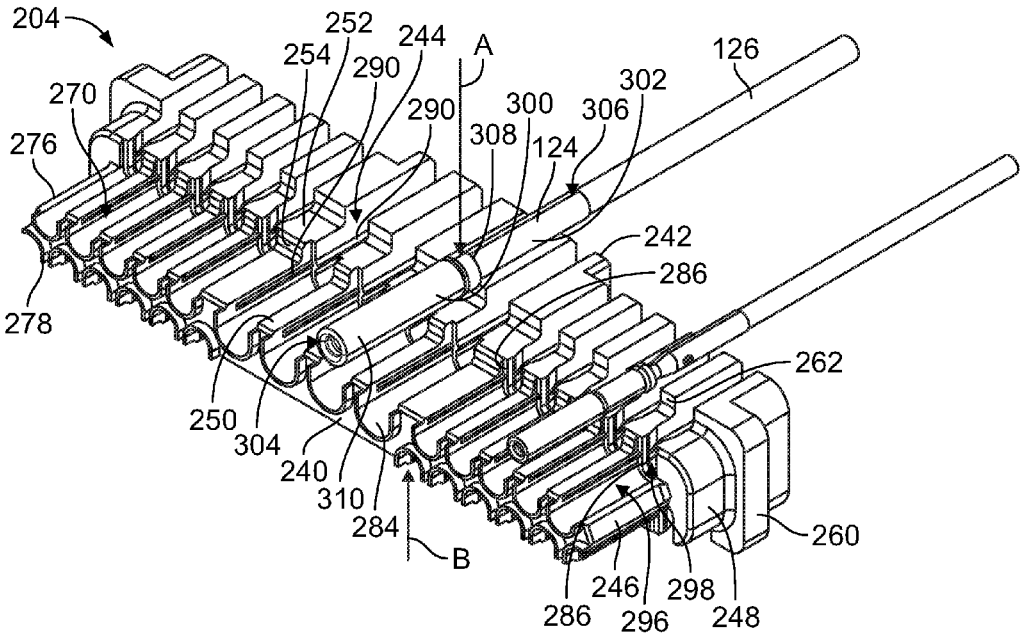
FIG. 6, which is a front perspective view of a contact organizer of the contact assembly.

With reference back to FIG. 4, and with additional reference to FIG. 6, which is a front perspective view of the contact organizer 204 showing contacts 124 poised for loading into the contact organizer 204, the contact organizer 204 extends between a front 240 and a rear 242. The contact organizer 204 includes contact channels 244 extending between the front 240 and the rear 242. The contact organizer 204 includes a tray 246 at the front 240 and the base 248 at the rear 242. The tray 246 extends forward from the base 248. In the illustrated embodiment, the base 248 is wider and taller than the tray 246. The tray 246 is configured to be received in the chamber 230. Optionally, at least a portion of the base 248, such as the front portion of the base 248, is configured to be received in the chamber 230. In an exemplary embodiment, the tray 246 includes platforms 250 along the top and the bottom of the tray 246. The base 248 includes platforms 252 along the top and the bottom of the tray 246. The platforms 252 of the base 248 are above and below the platforms 250 at the top and the bottom, respectively because the base 248 is taller than the tray 246. Shoulders 254 extend between the platforms 250, 252. The shoulders 254 are forward facing. When the contact organizer 204 is loaded into the front housing 202, the platforms 250, 252 engage the upper and lower walls 232, 234 (shown in FIG. 5). For example, the upper and lower walls 232, 234 may be stepped to engage the platforms 250 of the tray 246 and the platforms 252 of the base 248. The shoulders 254 may engage the front housing 202 to locate the contact organizer 204 relative to the front housing 202.

In an exemplary embodiment, the contact organizer 204 includes a flange 260 extending from the base 248. In the illustrated embodiment, the flange 260 extends from both sides of the contact organizer 204. Optionally, the flange 260 may extend from the top and/or the bottom of the base 248. In the illustrated embodiment, a portion of the base 248 extends rearward of the flange 260. However, in alternative embodiments, the flange 260 may be provided at the rear 242. In an exemplary embodiment, the contact organizer 204 is loaded into the chamber 230 of the front housing 202 such that the flange 260 of the contact organizer 204 engages the flange 222 of the front housing 202. The base 248 may include one or more stop shoulders 262 configured to engage the front housing 202 to locate the contact organizer 204 relative to the front housing 202.

Figure 7:
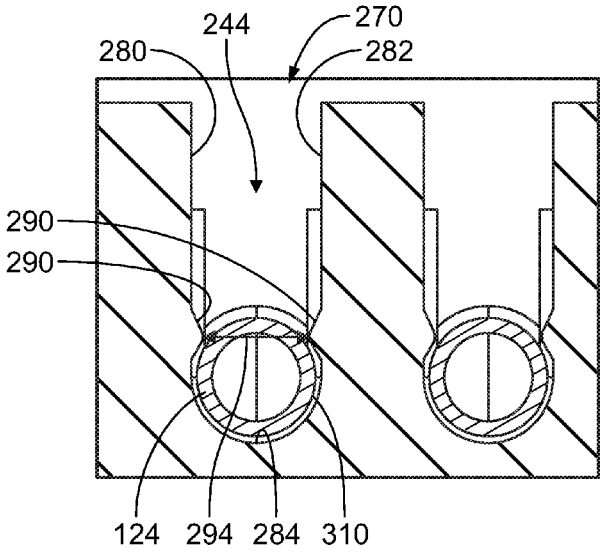
FIG. 7 is a cross-sectional view of a portion of the contact organizer showing contacts loaded in the contact organizer.

With additional reference to FIG. 7, which is a cross-sectional view of a portion of the contact organizer 204 showing contacts 124 loaded in the contact organizer 204, the contact channels 244 have open sides 270 to receive the contacts 124. The contacts 124 are received in corresponding contact channels 244 through the corresponding open sides 270. In the illustrated embodiment, the contact organizer 204 includes an upper row 272 of contact channels 244 and a lower row 274 of contact channels 244. The contact channels 244 in the upper row 272 have the open sides 270 at a top 276 of the contact organizer 204 while the contact channels 244 and the lower row 274 have the open sides 270 at a bottom 278 of the contact organizer 204. The contacts 124 are radially loaded into the upper row 272 of contact channels 244 from above, such as in the direction of arrow A, while the contacts 124 are radially loaded into the lower row 274 of contact channels 244 from below, such as in the direction of arrow B.

In an exemplary embodiment, the contacts 124 are configured to be terminated to the cables 126. The contact 124 extends between a mating end 300 and a terminating end 302. In the illustrated embodiment, the mating end 300 includes a socket 304 configured to receive the pin of the header contact 114; however, other types of contacts may be provided in alternative embodiments, such as a pin, a spring beam or another type of contact. In the illustrated embodiment, the terminating ends 302 includes a crimp barrel 306 configured to be crimped to the cable 126; however, other types of terminating ends may be provided in alternative embodiments, such as a solder barrel, an insulation displacement contact, or another type of terminating end.

Each contact channel 244 includes a first side 280 and a second side 282 extending from the open side 270 to a seat 284. The seats 284 of the contact channels 244 in the upper row 272 are at the bottoms of the corresponding contact channels 244, while the seats 284 of the contact channels 244 in the lower row 274 are at the tops of the corresponding contact channels 244. The contacts 124 are pushed into the contact channels 244 against the corresponding seats 284.

In an exemplary embodiment, the contacts 124 are side loaded into the contact channels 244 rather than being end loaded through the rear 242 or the front 240. The open sides 270 allow side loading of the contacts 124 into the contact channels 244. In an exemplary embodiment, each contact channel 244 includes one or more locating shoulders 286 for axially locating the contact 124 within the contact channel 244. In the illustrated embodiment, the locating shoulder 286 is forward facing. The locating shoulder 286 engages a flange 308 on the contact 124 to hold the axial position of the contact 124 within the contact channel 244. For example, the flange 308 abuts against the locating shoulder 286 to resist movement of the contact 124 within the contact channel 244. Optionally, the locating shoulder 286 may be rearward facing rather than forward facing to resist movement of the contact 124 and a forward direction within the contact channel 244. In other various embodiments, the contact channel 244 may include both a forward facing locating shoulder and a rearward facing locating shoulder to resist axial movement of the contact 124 in either the forward direction or the rearward direction.

In an exemplary embodiment, each contact channel 244 includes one or more securing detents 290 extending into the contact channel 244. In the illustrated embodiment, the securing detents 290 are arranged in pairs extending into the contact channel 244 from both sides 280, 282 of the contact channel 244; however, other embodiments may include a single securing detent 290 extending from one of the sides 280 or 282. The securing detents 290 engage an exterior surface 310 of the contact 124 to retain the contact 124 and the contact channel 244 by resisting removal through the open side 270. The securing detents 290 are spaced apart from the seat 284 to accommodate the diameter of the contact 124. The securing detents 290 may securely hold the contact 124 against the seat 284. In an exemplary embodiment, the securing detents 290 are compressible to allow the contact 124 to pass between the securing detents 290 to engage the seat 284. The securing detents 290 are then deflected into a holding position radially outside of the exterior surface 310 of the contact 124 to resist removal of the contact 124 from the contact channel 244. Optionally, the contact 124 may snap into the seat 284 past the securing detents 290 during assembly with the securing detents 290 snapping back around the contact 124 when the contact 124 is fully loaded into the contact channel 244. The securing detents 290 may have a lateral spacing 294 therebetween smaller than the diameter of the contact 124. The securing detents 290 may be compressed are deflected out of the way to allow the contact 124 to loaded to the seat 284 and then released to a blocking position relative to the contact 124.

In an exemplary embodiment, each contact channel 244 includes a front channel segment 296 and a rear channel segment 298. The front channel segment 296 extends along the tray 246. The rear channel segment 298 extends along the base 248. Optionally, the locating shoulder 286 is provided at the intersection between the front and rear channel segments 296, 298. In an exemplary embodiment, the front channel segment 296 receives the mating end 300 of the contact 124 and the rear channel segment 298 receives the terminating end 302 of the contacts 124. In an exemplary embodiment, the front channel segment 296 includes forward securing detents 290 and the rear channel segment 298 includes rearward securing detents 290. The forward securing detents 290 retain the mating ends 300 and the front channel segment 296. The rearward securing detents 290 secure the terminating end 302 and the rear channel segment 298. Optionally, the rear channel segments 298 may have a longitudinal length longer than the terminating end 302 such that the terminating end 302 is forward of the rear 242 of the contact organizer 204. The cable 126 extends from the terminating ends 302 a distance within the rear channel segment 298 before exiting the contact organizer 204. Optionally, the mating end 300 of the contact 124 may have a longitudinal length longer than the front channel segment 296 such that the distal end is forward of the front 240 of the contact organizer 204. The mating end 300 extends forward of the tray 246 for loading into the front housing 202. Optionally, the front and rear channel segments 296, 298 may have different sizes. For example, the front channel segment 296 may be larger than the rear channel segment 298. For example, the mating end 300 may have a larger diameter than the terminating ends 302 and the front channel segment 296 is larger than the rear channel segment 298 to accommodate the mating end 300 and the terminating end 302, respectively.

Optionally, portions of the contacts 124 are exposed along the tray 246. For example, the platforms 250 may be approximately coplanar with the outer edges of the mating ends 300. For example, the securing detents 290 and the front channel segments 296 may be provided at or near the top 276 and the bottom 278 such that the mating ends 300 are exposed along the top 276 and the bottom 278. When the contact organizer 204 is loaded in the front housing 202 the upper wall 232 and the lower wall 234 of the front housing 202 covers the exposed portions of the mating ends 300 at the open sides 270. The front housing 202 thus closes the open sides 270 along the tray 246 when the contact organizer 204 is loaded in the front housing 202. As such, the mating ends 300 are entirely circumferentially surrounded by the contact organizer 204 (first side 280, seat 284 and a second side 282) and the front housing 202.

Figure 8:
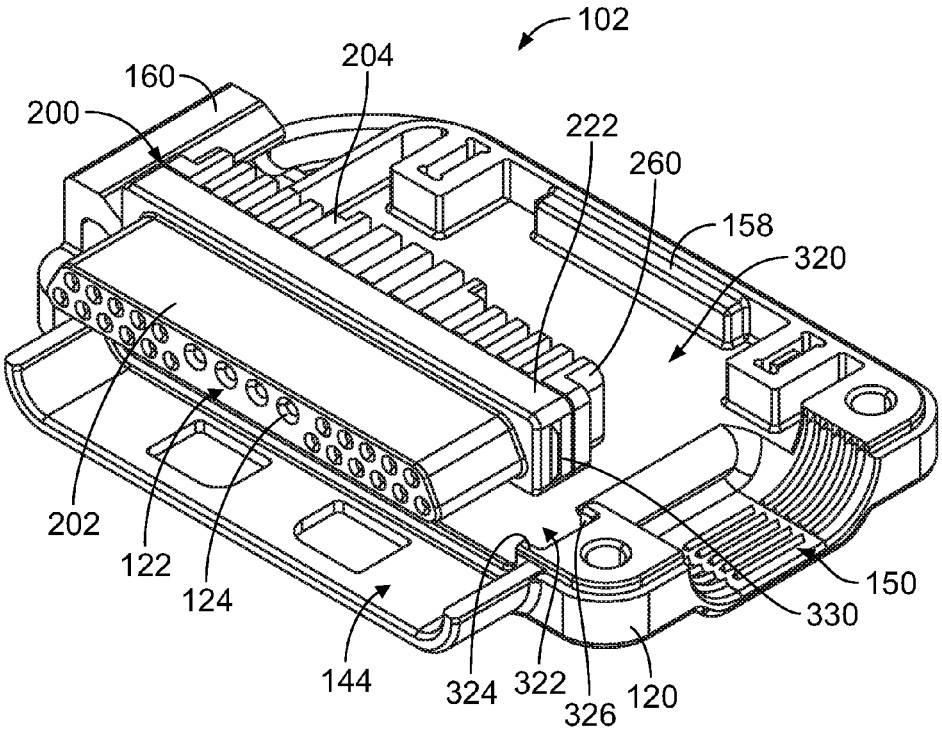
FIG. 8 is a top perspective view of a portion of the electrical connector.
Figure 9:
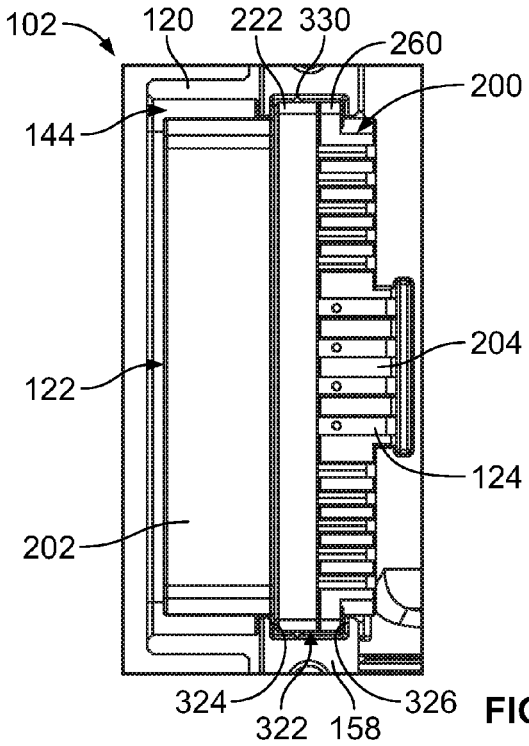
FIG. 9 is a top view of a portion of the electrical connector.
Figure 10:
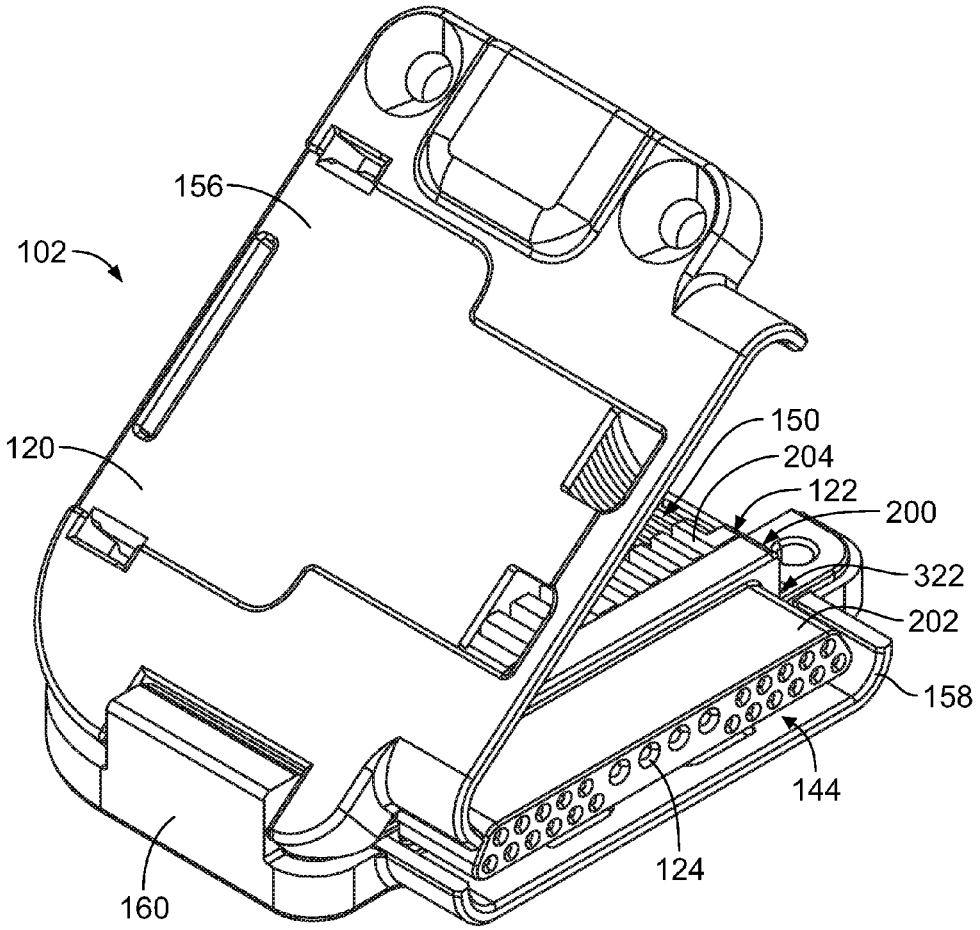
FIG. 10 is a front perspective view of a portion of the electrical connector.

FIG. 8 is a top perspective view of a portion of the electrical connector 102 showing the contact assembly 122 being loaded into the lower shell 158 of the shell 120. FIG. 9 is a top view of a portion of the electrical connector 102 showing the contact assembly 122 loaded into the lower shell 158 of the shell 120. FIG. 10 is a front perspective view of a portion of the electrical connector 102 showing the contact assembly 122 loaded in the lower shell 158 and the upper shell 156 of the shell 120 being coupled to the lower shell 158 and the contact assembly 122. The cables 126 (shown in FIG. 1) are removed for clarity in FIGS. 8-10.

The contact assembly 122 is received in the shell 120 between the mating cavity 144 and a cable cavity 320 of the shell 120. The cable cavity 320 is open to the cable port 150. The cables 126 extend from the contact assembly 122 through the cable cavity 320 to the cable port 150.

In an exemplary embodiment, the shell 120 includes a pocket 322 between the mating cavity 144 and the cable cavity 320. For example, the pocket 322 is rearward of the mating cavity 144 and forward of the cable cavity 320. The pocket 322 receives the contact assembly 122. In an exemplary embodiment, the pocket 322 is defined by a forward ledge 324 and a rearward ledge 326. The pocket 322 defines a space between the forward ledge 324 and the rearward ledge 326 that receives the flange 222 of the front housing 202 and the flange 260 of the contact organizer 204. The flanges 222, 260 are sandwiched between the forward ledge 324 and the rearward ledge 326 to locate the contact holder 200 within the shell 120. Optionally, prior to loading the contact holder 200 into the pocket 322, the contact organizer 204 may be loosely coupled to the front housing 202 such that the contact organizer 204 may be freely separated from the front housing 204. However, once the flanges 222, 260 are received in the pockets 322, the contact organizer 204 is restricted from the coupling from the front housing 202. The shell 120 holds the contact organizer 204 and the front housing 202 and the contact organizer 204 holds the contacts 124 and the front housing 202.

Optionally, the flange 222 and/or the flange 260 may include crush ribs 330 for locating the contact assembly 122 and the shell 120. When the flange 222 is loaded in the pocket 322, the crush ribs 330 are compressed and/or crushed to securely hold a side-to-side position of the contact assembly 122 in the pocket 322.

Once the contact assembly 122 is loaded in the lower shell 158, the upper shell 156 may be coupled to the lower shell 158 to enclose the contact assembly 122 and the shell 120. In an exemplary embodiment, the upper shell 156 includes a complementary half of the pocket 322. In the illustrated embodiment, the upper shell 156 is hingedly coupled to the lower shell 158 at the hinge 160. Once the upper shell 156 is closed on the lower shell 158 around the contact assembly 122, fasteners may be used to secure the upper shell 156 to the lower shell 158. Alternatively, the upper shell 156 may be coupled to the lower shell 158 without the hinge 160, such as using fasteners. In another embodiment, latching features on the shells 156, 158 may be used to couple the shells 156, 158 to each other. The clip 128 (shown in FIG. 1) may be coupled to the shell 120 before or after assembling the contact assembly 122 and the shell 120.

Figure 11:
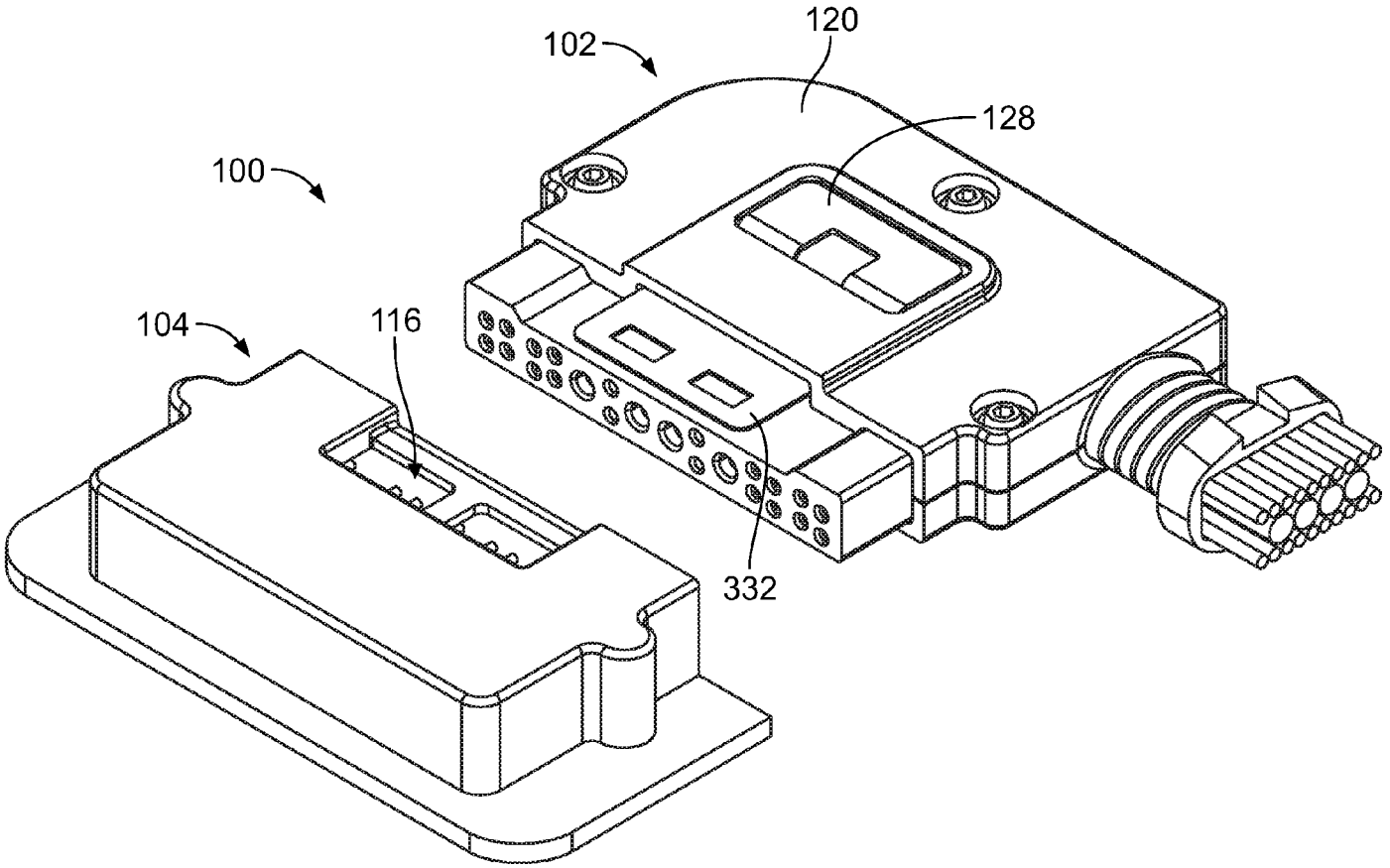
FIG. 11 is a perspective view of the electrical connector system formed in accordance with an exemplary embodiment showing the electrical connector poised for mating with the header connector.

FIG. 11 is a perspective view of the electrical connector system 100 formed in accordance with an exemplary embodiment showing the electrical connector 102 poised for mating with the header connector 104. The electrical connector system 100 shown in FIG. 11 includes different types of latching features for securing the electrical connector 102 to the header connector 104. In the illustrated embodiment, a portion of the clip 128 is internal of the shell 120. A latching end 332 of the clip 128 is configured to be latchably secured to a complementary latching feature 116 of the header connector 104.

Figure 12:
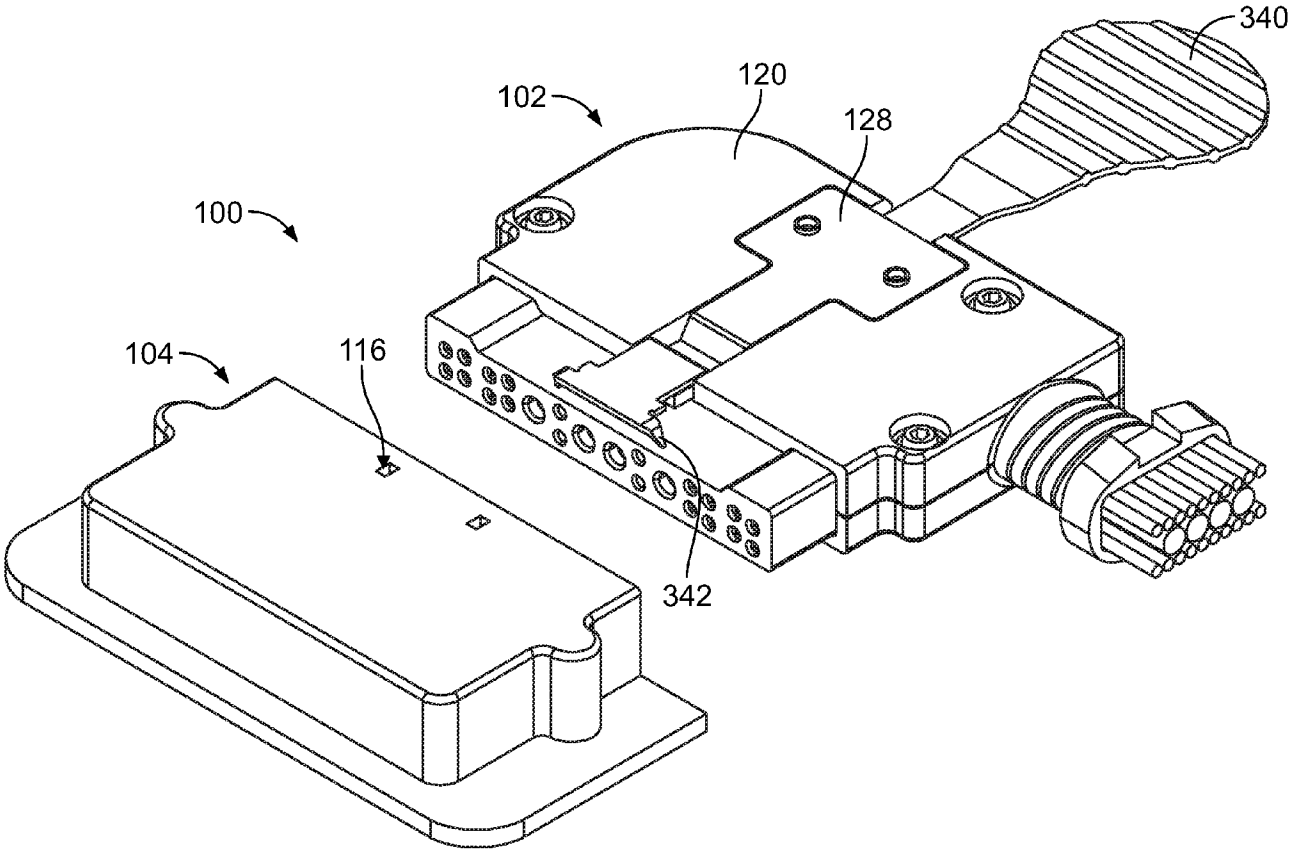
FIG. 12 is a perspective view of the electrical connector system formed in accordance with an exemplary embodiment showing the electrical connector poised for mating with the header connector.

FIG. 12 is a perspective view of the electrical connector system 100 formed in accordance with an exemplary embodiment showing the electrical connector 102 poised for mating with the header connector 104. The electrical connector system 100 shown in FIG. 12 includes different types of latching features for securing the electrical connector 102 to the header connector 104. In the illustrated embodiment, the latching feature of the electrical connector 102 includes a pull tab 340 for releasing a latching end 342 of the clip 128. The latching feature 116 of the header connector 104 includes openings for receiving the latching end 342.

Figure 13:
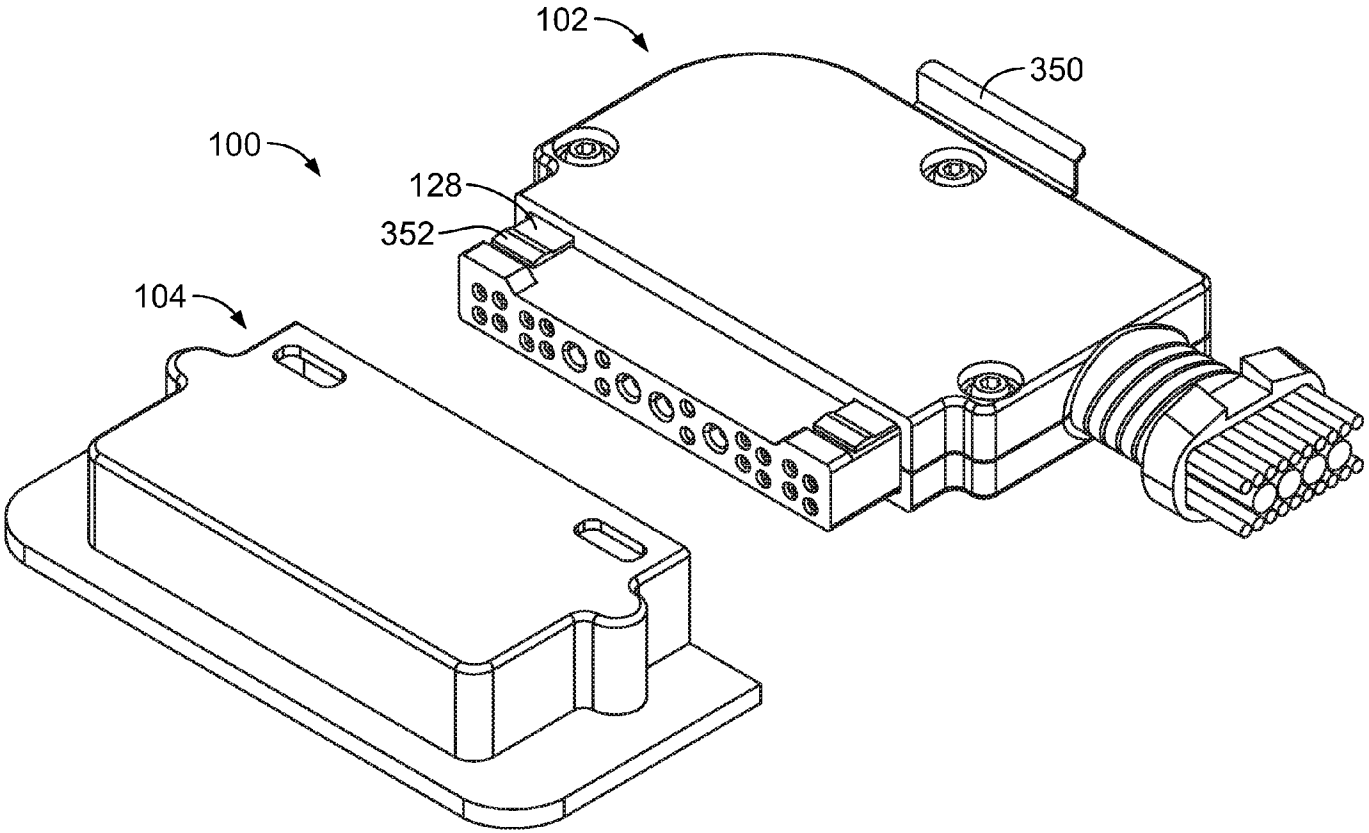
FIG. 13 is a perspective view of the electrical connector system formed in accordance with an exemplary embodiment showing the electrical connector poised for mating with the header connector.

FIG. 13 is a perspective view of the electrical connector system 100 formed in accordance with an exemplary embodiment showing the electrical connector 102 poised for mating with the header connector 104. The electrical connector system 100 shown in FIG. 13 includes different types of latching features for securing the electrical connector 102 to the header connector 104. In the illustrated embodiment, the latching feature of the electrical connector 102 includes a slide 350 for releasing a latching end 352 of the clip 128. The latching feature 116 of the header connector 104 includes openings for receiving the latching end 352.

Figure 14:
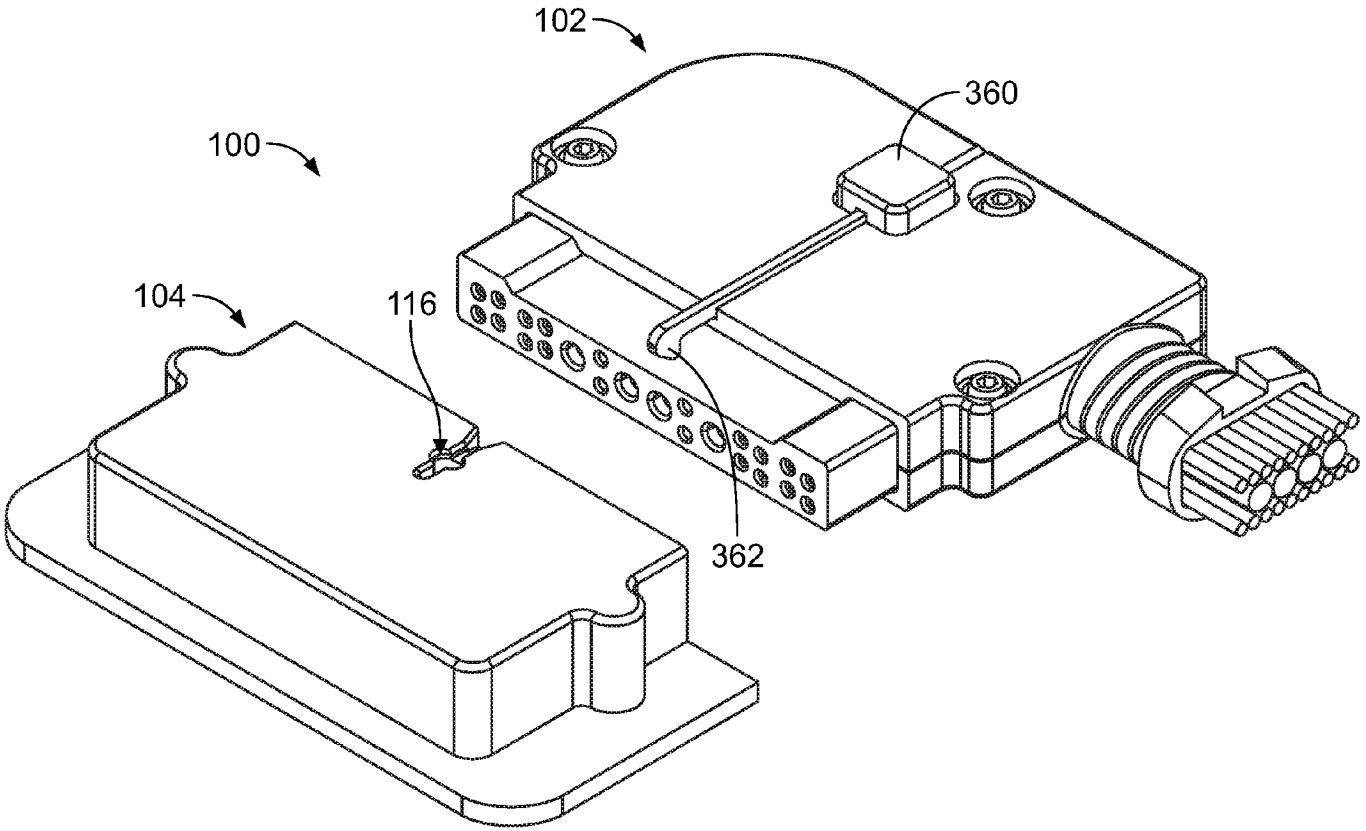
FIG. 14 is a perspective view of the electrical connector system formed in accordance with an exemplary embodiment showing the electrical connector poised for mating with the header connector.

FIG. 14 is a perspective view of the electrical connector system 100 formed in accordance with an exemplary embodiment showing the electrical connector 102 poised for mating with the header connector 104. The electrical connector system 100 shown in FIG. 14 includes different types of latching features for securing the electrical connector 102 to the header connector 104. In the illustrated embodiment, the latching feature of the electrical connector 102 includes a push button 360 for releasing a latching end 362 of the clip 128. The latching feature 116 of the header connector 104 includes an opening for receiving the latching end 362.

Figure 15:
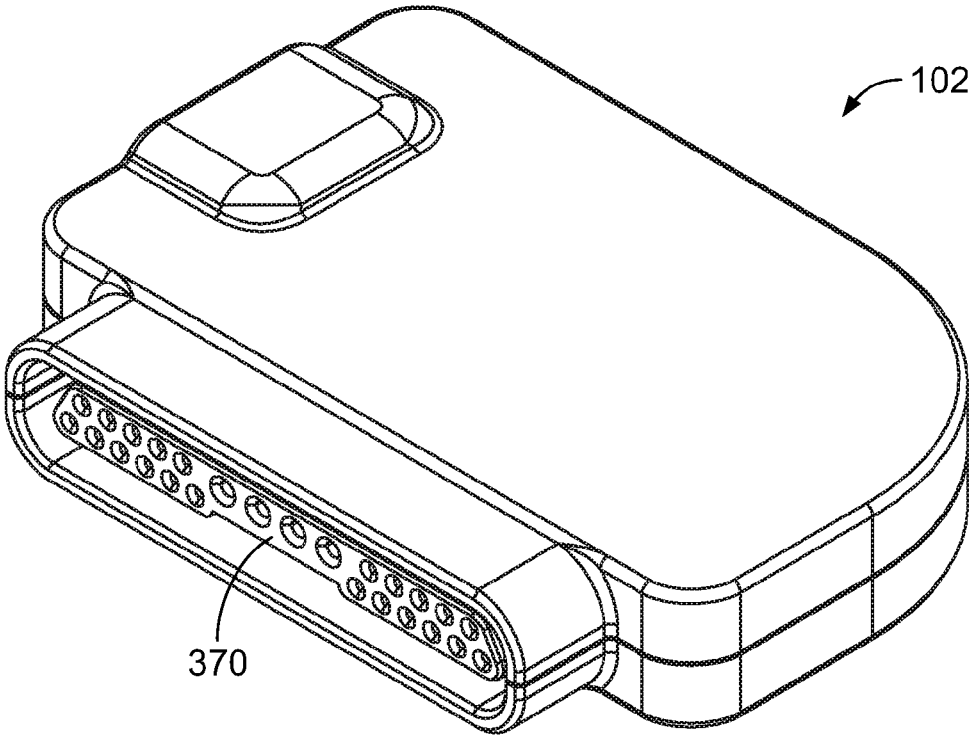
FIG. 15 is a perspective view of the electrical connector system formed in accordance with an exemplary embodiment showing the electrical connector in accordance with an exemplary embodiment.

FIG. 15 is a perspective view of the electrical connector system 100 formed in accordance with an exemplary embodiment showing the electrical connector 102 in accordance with an exemplary embodiment. The electrical connector system 100 shown in FIG. 15 includes different types of latching features for securing the electrical connector 102 to the header connector 104. In the illustrated embodiment, the latching feature of the electrical connector 102 includes a passive latch 370 for latchably coupling to the header connector (shown in FIG. 1). The passive latch 370 is not actively released, but is released by pulling on the electrical connector 102 in an unmating direction hard enough to overcome the spring force of the passive latch 370 on the latching feature (for example, ramp) of the header connector 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a shell having a mating cavity at a front of the shell and a cable cavity at a rear of the shell, the shell having a cable port between the cable cavity and an exterior of the shell receiving cables through the cable port;

a contact organizer received in the shell, the contact organizer including contact channels each having an open side between a front and a rear of the contact organizer, the contact organizer having locating shoulders in corresponding contact channels, the contact organizer having securing detents extending into corresponding contact channels; and contacts terminated to corresponding cables, the contacts being received in corresponding contact channels through the corresponding open sides, each contact having a flange engaging the corresponding locating shoulder to hold an axial position of the contact within the contact channel, each contact having an exterior surface engaging the corresponding securing detent to retain the contact in the contact channel by resisting removal through the open side.

2. The electrical connector of claim 1, wherein the contact channels are arranged in an upper row and a lower row, the open sides of the contact channels on the upper row being at a top of the contact organizer, the open sides of the contact channels on the lower row being at a bottom of the contact organizer.

3. The electrical connector of claim 1, wherein the contacts are radially loaded into the contact channels through the open sides.

4. The electrical connector of claim 1, wherein the contacts include mating ends and terminating ends terminated to the cables, the terminating ends being axially positioned forward of the rear of the contact organizer, the mating ends being axially positioned forward of the front of the contact organizer.

5. The electrical connector of claim 1, wherein the cables extend into the contact channels.

6. The electrical connector of claim 1, wherein the contact channels are larger forward of the locating shoulders and a smaller rearward of the locating shoulders.

7. The electrical connector of claim 1, wherein the locating shoulders are forward facing to restrict axially rearward movement of the contacts relative to the contact organizer.

8. The electrical connector of claim 1, wherein each contact has a diameter, the securing detents being arranged in pairs on opposite sides of the contact channels having a lateral spacing therebetween smaller than the diameter of the corresponding contact, the contact being snapped into the contact channel interior of the securing detents to secure the contact in the contact channel.

9. The electrical connector of claim 1, wherein the contact organizer further includes a front housing, the front of the contact organizer being coupled to the front housing.

10. The electrical connector of claim 1, wherein the contact organizer further includes a front housing, the front of the contact organizer being received in the front housing such that the front housing closes portions of the contact channels.

11. The electrical connector of claim 10, wherein the contacts include mating ends, the mating ends being entirely circumferentially surrounded by the contact organizer and the front housing.

12. The electrical connector of claim 1, wherein the contacts include mating ends forward of the flanges and terminating ends rearward of the flanges, the securing detents including forward securing detents and rearward securing detents, the forward securing detents engaging the mating ends of corresponding contacts, the rearward securing detents engaging the terminating ends of corresponding contacts.

13. The electrical connector of claim 1, wherein the shell includes a recess, a clip being received in the recess for latch of the engaging a mating connector.

14. The electrical connector of claim 1, wherein the shell includes a pocket, the contact organizer including a flange received in the pocket to secure the contact organizer relative to the shell.

15. The electrical connector of claim 1, wherein the shell includes a lower shell and an upper shell pivotably coupled to the lower shell.

16. The electrical connector of claim 1, wherein the shell includes a stuffer extending therefrom sized and shaped to fit in the contact channels, the stuffer engaging the contacts to force the contacts into the contact channels through the open sides.

17. An electrical connector comprising:

a shell having a mating cavity at a front of the shell and a cable cavity at a rear of the shell, the shell having a cable port between the cable cavity and an exterior of the shell receiving cables through the cable port;

a contact holder received in the shell, the contact holder including a front housing and a contact organizer coupled to a rear of the front housing, the front housing having a nose at a front of the front housing received in the mating cavity, the front housing including a chamber at the rear of the front housing, the front housing including contact bores extending between the front and the rear of the contact holder, the contact organizer including contact channels each having an open side between a front and a rear of the contact organizer, the contact organizer having a tray at the front of the contact organizer, the tray including front channel segments of the contact channels, the contact organizer being coupled to the front housing such that the tray is received in the chamber of the front housing such that the front housing closes the open sides of the front channel segments of the contact channels; and contacts being received in corresponding contact channels through the corresponding open sides, the contacts having mating ends received in corresponding contact bores in the front housing, the contacts having terminating ends terminated to corresponding cables.

18. The electrical connector of claim 17, wherein the contact organizer includes locating shoulders in corresponding contact channels and securing detents extending into corresponding contact channels, the contacts having flanges engaging the corresponding locating shoulders to hold axial positions of the contacts within the contact channels, the contacts having exterior surfaces engaging the corresponding securing detents to retain the contacts in the contact channels by resisting removal through the open sides.

19. An electrical connector comprising:

a shell having a mating cavity at a front of the shell and a cable cavity at a rear of the shell, the shell having a cable port between the cable cavity and an exterior of the shell receiving cables through the cable port, the shell having a pocket rearward of the mating cavity;

a contact holder received in the shell and secured in the pocket, the contact holder including a front housing and a contact organizer coupled to a rear of the front housing, the front housing including a flange having a front lip, the front housing having a nose extending forward of the front lip and being received in the mating cavity, the front housing including contact bores, the contact organizer having a flange having a rear lip, the contact organizer including contact channels each having an open side between a front and a rear of the contact organizer; and contacts being received in corresponding contact channels through the corresponding open sides, the contacts having mating ends received in corresponding contact bores in the front housing, the contacts having terminating ends terminated to corresponding cables;

wherein the flange of the front housing and the flange of the contact organizer are received in the pocket and secured in the pocket to secure the contact organizer to the front housing.

20. The electrical connector of claim 19, wherein the flange of the front housing and the flange of the contact organizer are coupled together and sandwiched between a forward ledge and a rearward ledge of the pocket.

21. The electrical connector of claim 19, wherein the contact organizer includes locating shoulders in corresponding contact channels and securing detents extending into corresponding contact channels, the contacts having flanges engaging the corresponding locating shoulders to hold axial positions of the contacts within the contact channels, the contacts having exterior surfaces engaging the corresponding securing detents to retain the contacts in the contact channels by resisting removal through the open sides.

* * * * *